US009784471B2

(12) United States Patent
Lee et al.

(10) Patent No.: US 9,784,471 B2
(45) Date of Patent: Oct. 10, 2017

(54) CARTRIDGE-TYPE INLINE HEATER AND SYSTEM FOR CONTROLLING WORKING FLUID TEMPERATURE USING THE SAME

(71) Applicant: KOREA INSTITUTE OF MACHINERY & MATERIALS, Daejeon (KR)

(72) Inventors: Jung Ho Lee, Daejeon (KR); Kong Hoon Lee, Daejeon (KR); Seok Ho Yoon, Daejeon (KR); Young Kim, Daejeon (KR)

(73) Assignee: KOREA INSTITUTE OF MACHINERY & MATERIALS, Daejeon (KR)

( * ) Notice: Subject to any disclaimer, the term of this patent is extended or adjusted under 35 U.S.C. 154(b) by 0 days.

(21) Appl. No.: 13/990,871

(22) PCT Filed: Nov. 16, 2012

(86) PCT No.: PCT/KR2012/009761

§ 371 (c)(1),
(2) Date: May 31, 2013

(87) PCT Pub. No.: WO2013/073905

PCT Pub. Date: May 23, 2013

(65) Prior Publication Data

US 2014/0287374 A1 Sep. 25, 2014

(30) Foreign Application Priority Data

Nov. 18, 2011 (KR) ..... 10-2011-0120553

(51) Int. Cl.
*F24H 1/16* (2006.01)
*F24H 1/10* (2006.01)
(Continued)

(52) U.S. Cl.
CPC ..... *F24H 1/162* (2013.01); *F24H 1/10* (2013.01); *F24H 1/16* (2013.01); *F24H 9/20* (2013.01); *H05B 3/40* (2013.01)

(58) Field of Classification Search
CPC ... F24H 1/16; F24H 1/162; F24H 1/10; F24H 1/106; F24H 1/12; F24H 1/14; F24H 1/142; F28F 13/12
(Continued)

(56) References Cited

U.S. PATENT DOCUMENTS 1,382,156 A * 6/1921 Abogado ..... F24H 1/106 392/315
1,689,521 A * 10/1928 Dominguez ..... 392/320
(Continued)

FOREIGN PATENT DOCUMENTS

EP 0257220 * 3/1988
JP 2000-259259 9/2000
(Continued)

OTHER PUBLICATIONS

PCT Search Report & Written Opinion of PCT/KR2012/009761 (dated Feb. 18, 2013).

*Primary Examiner* — Steven B. McAllister
*Assistant Examiner* — Ko-Wei Lin
(74) *Attorney, Agent, or Firm* — Lex IP Meister, PLLC

(57) ABSTRACT

The present invention relates to a cartridge-type inline heater including: a heat exchanging unit including a body part in which a mounting part is formed in a longitudinal direction, and swirl parts coiled in a spiral along the longitudinal direction of the body part, and configured to induce a flowing-in working fluid to flow along the swirl parts; and a heater inserted in a longitudinal direction of the heat exchanging part to heat the working fluid which is in contact with the heat exchanging unit.
Accordingly, the cartridge-type inline heater capable of heating the working fluid so as to have improved durability and uniform temperature distribution is provided.

3 Claims, 7 Drawing Sheets

(51) Int. Cl.
*H05B 3/40* (2006.01)
*F24H 9/20* (2006.01)

(58) Field of Classification Search
USPC ..... 392/470, 497, 473, 487, 488, 489; 165/109.1, 183–184, 181, 96
See application file for complete search history.

(56) References Cited

U.S. PATENT DOCUMENTS

| | | | | | |
|---|---|---|---|---|---|
| 2,775,683 | A * | 12/1956 | Kleist | F25B 43/00 | 222/146.3 |
| 6,205,292 | B1 * | 3/2001 | Pokorny | F24H 1/142 | 392/465 |
| 2003/0116306 | A1 * | 6/2003 | Besik | 165/109.1 | |
| 2007/0235440 | A1 * | 10/2007 | Gu et al. | 219/482 | |
| 2011/0094721 | A1 * | 4/2011 | Tsai | F28F 1/40 | 165/181 |

FOREIGN PATENT DOCUMENTS

| | | | |
|---|---|---|---|
| JP | 2006207936 | A * | 8/2006 |
| KR | 1990-004149 | | 2/1990 |
| KR | 10-2002-0049086 | | 6/2002 |
| KR | 10-2005-0118634 | | 12/2005 |
| KR | 10-2006-0049326 | | 5/2006 |
| KR | 10-2007-0052873 | | 5/2007 |
| KR | 10-2008-0023446 | | 3/2008 |
| KR | 10-2008-0057742 | | 6/2008 |
| KR | 10-2008-0078637 | | 8/2008 |
| KR | 20-2011-0009795 | | 10/2011 |

* cited by examiner

CARTRIDGE-TYPE INLINE HEATER AND SYSTEM FOR CONTROLLING WORKING FLUID TEMPERATURE USING THE SAME

BACKGROUND OF THE INVENTION (a) Field of the Invention

The present invention relates to a cartridge-type inline heater, and a system for controlling a working fluid temperature using the same, and more particularly, to a cartridge-type inline heater capable of heating a working fluid so as to have a uniform temperature gradient, and a system for controlling a working fluid temperature using the same.

(b) Description of the Related Art

In general, flow assurance in mining oil and gas refers to assurance of stable and economic transference of oil and gas by controlling a temperature, a flow rate, and pressure of a flow within a pipe line through which a resource material is transferred from a reserve place to a consumption place after the resource material is minded.

In the meantime, the most significant factor influencing on flow assurance of the pipe line in transferring resources of an offshore plant including a deep sea floor mainly includes a clogged-up phenomenon of a pipe line due to a solid material, such as gas hydrate or wax, damage to the pipe line due to a slugging phenomenon of a multiphase flow, a change in a flow speed due to large pressure drop within the pipe line, a change in viscosity, and thermal loss.

Accordingly, in order to secure flow assurance of the pipe line, it is necessary to control a temperature of a working fluid within in the pipe line in order to prevent the solid material, such as gas hydrate or wax, from being generated.

In the meantime, in a case of a heat unit process of a petrochemical plant and an internal unit process of a nuclear plant system, the working fluid flowing through the process accompanies various phase changes. In this case, a pipe-type inline heater is greatly used for the purpose of controlling a temperature of the working fluid during the transference of the working fluid from each unit process to a next unit process.

The heater uses a method in which a heater is mounted in a pipe-type flow path connecting the respective unit processes, and the working fluid flowing through heat generated from the heater is heated.

FIG. 1 illustrates an example of an inline heater in the related art.

As illustrated in FIG. 1, the inline heater 10 in the related art generally employs a method of directly heating a working fluid by mounting a coil-type metal heating element 12 inside a pipe 11.

However, in a case of the inline heater 10 in the related art, the inserted coil-type metal heating element 12 is directly exposed to the working fluid so that the coil-type metal heating element 12 is vulnerable to physical damage, and has a problem of a short lifespan. Particularly, in a case where even a part of the coil-type metal heating element 12 is a short circuit, a lot of time is taken for replacing or repairing the coil-type metal heating element 12, so that there is a problem in that a yield of the entire process is decreased.

Further, there is a problem in that a calorie supplied to a region in which the metal heating element 12 is mounted is different from a calorie supplied to a region in which the metal heating element 12 is not mounted, and uniformity of a temperature distribution of the working fluid heated inside the pipe is not secured.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a cartridge-type inline heater capable of performing heating at a uniform temperature regardless of a position inside a pipe.

Further, the present invention has been made in an effort to provide a system for controlling a working fluid temperature capable of easily controlling a working fluid temperature for each section by using a cartridge-type inline heater.

An exemplary embodiment of the present invention provides a cartridge-type inline heater, including: a heat exchanging unit including a body part in which a mounting part is formed in a longitudinal direction, and swirl parts coiled in a spiral in the longitudinal direction of the body part, and configured to induce a flowing-in working fluid to flow along the swirl parts; and a heater inserted in a longitudinal direction of the heat exchanging unit and configured to heat the working fluid which is in contact with the heat exchanging unit.

Further, a plurality of swirl parts may be formed to be spaced apart from each other in a circumferential direction of the body part, and the cartridge-type inline heater may further include an exterior part mounted to be spaced apart from the body part while surrounding the swirls parts.

Further, the exterior part may be mounted to be in close contact with the swirl parts so as to prevent the working fluid flowing inside any one fluid flowing path based on the swirl parts from flowing to an adjacent fluid flowing path.

Further, a flow pattern may be formed on a surface of the swirl part which is in contact with the working fluid so that pressure resistance between the swirl part and the working fluid is decreased.

Another exemplary embodiment of the present invention provides a system for controlling a working fluid temperature using a cartridge-type inline heart, the system including: a temperature control section in which the plurality of cartridge-type inline heaters is arranged in a straight-type or in a parallel-type; and a controller configured to control the respective cartridge-type inline heaters within the temperature control section.

According to the cartridge-type heater of the exemplary embodiments of the present invention, it is possible to improve durability by inserting the cartridge-type heater inside the heating exchange unit to heat the working fluid through indirect contact.

Further, the spiral shaped swirl parts on the exterior surface of the heat exchanging unit induce stirring of the heated working fluid, so that it is possible to secure uniformity of a temperature of the working fluid.

Further, it is possible to decrease flow resistance, such as pressure resistance and friction resistance, and improve fluidity of the working fluid by forming a flow pattern in the spiral shaped swirl parts.

Further, the cartridge-type heater may be used for improving fluid assurance of a pipe line of an offshore plant, and may be used even in the process to which a fluid flow with high pressure or a high temperature is applied, such as a heating unit process of a petrochemical plant and an internal unit process of a nuclear plant system.

DETAILED DESCRIPTION OF THE EMBODIMENTS

Figure 1:
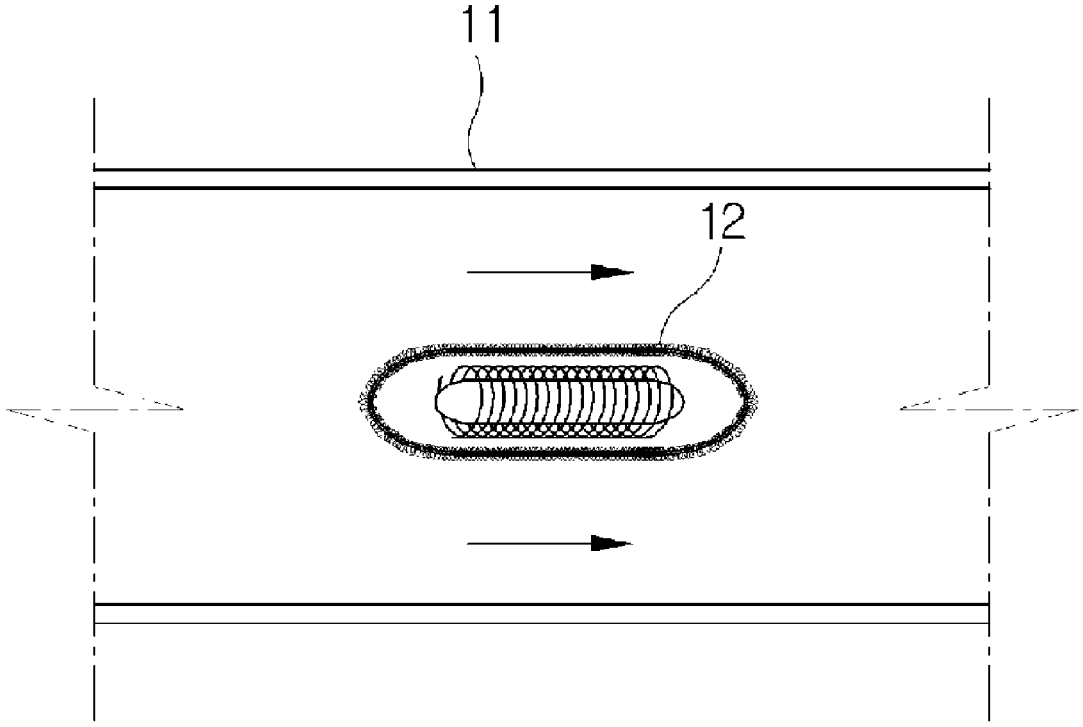
FIG. 1 illustrates an example of an inline heater in the related art.

Before the description, in several exemplary embodiments, since like reference numerals designate like elements having the same configuration, a first exemplary embodiment is representatively described, and in other exemplary embodiments, only a configuration different from the first exemplary embodiment will be described.

Hereinafter, a cartridge-type inline heater 100 according to a first exemplary embodiment of the present invention will be described in detail with reference to the accompanying drawings.

Figure 2:
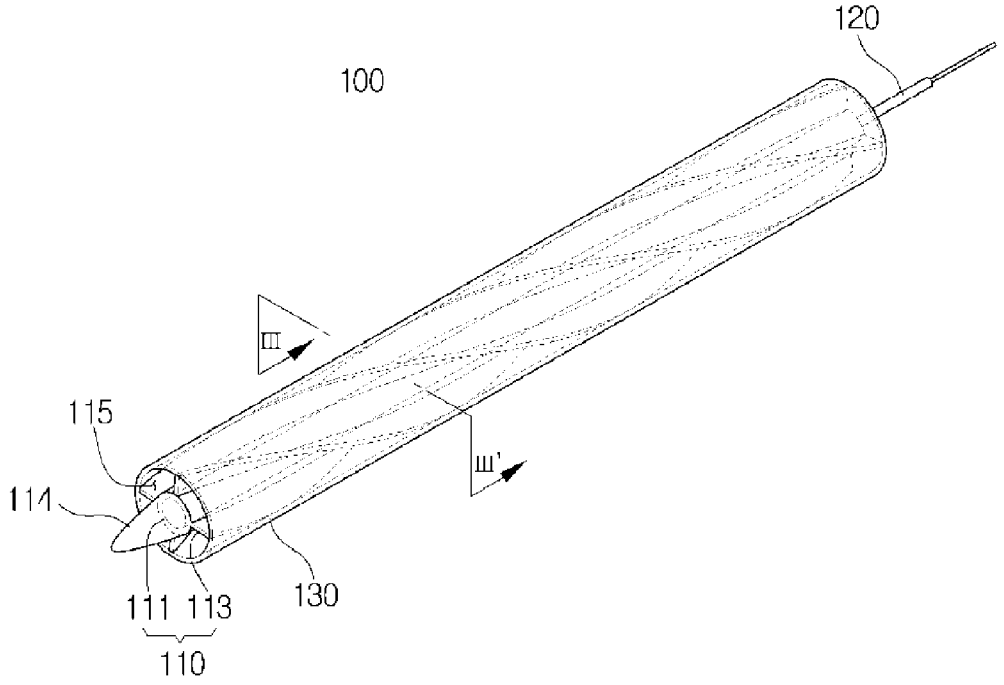
FIG. 2 is a perspective view of a cartridge-type inline heater according to a first exemplary embodiment of the present invention.
Figure 3:
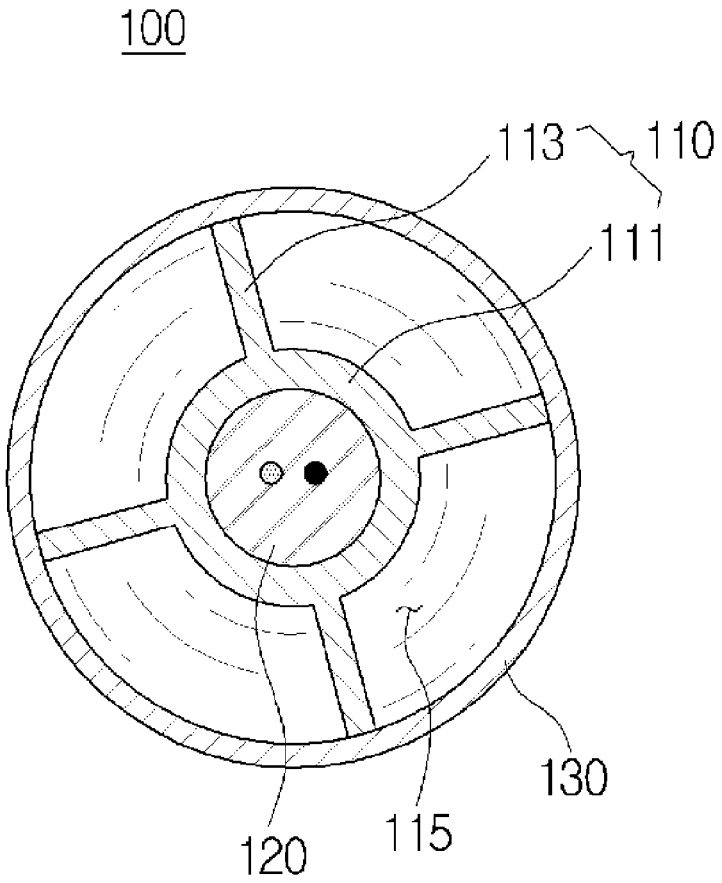
FIG. 3 illustrates a cross section of the cartridge-type inline heater taken along line III-III' of FIG. 2.
Figure 4:
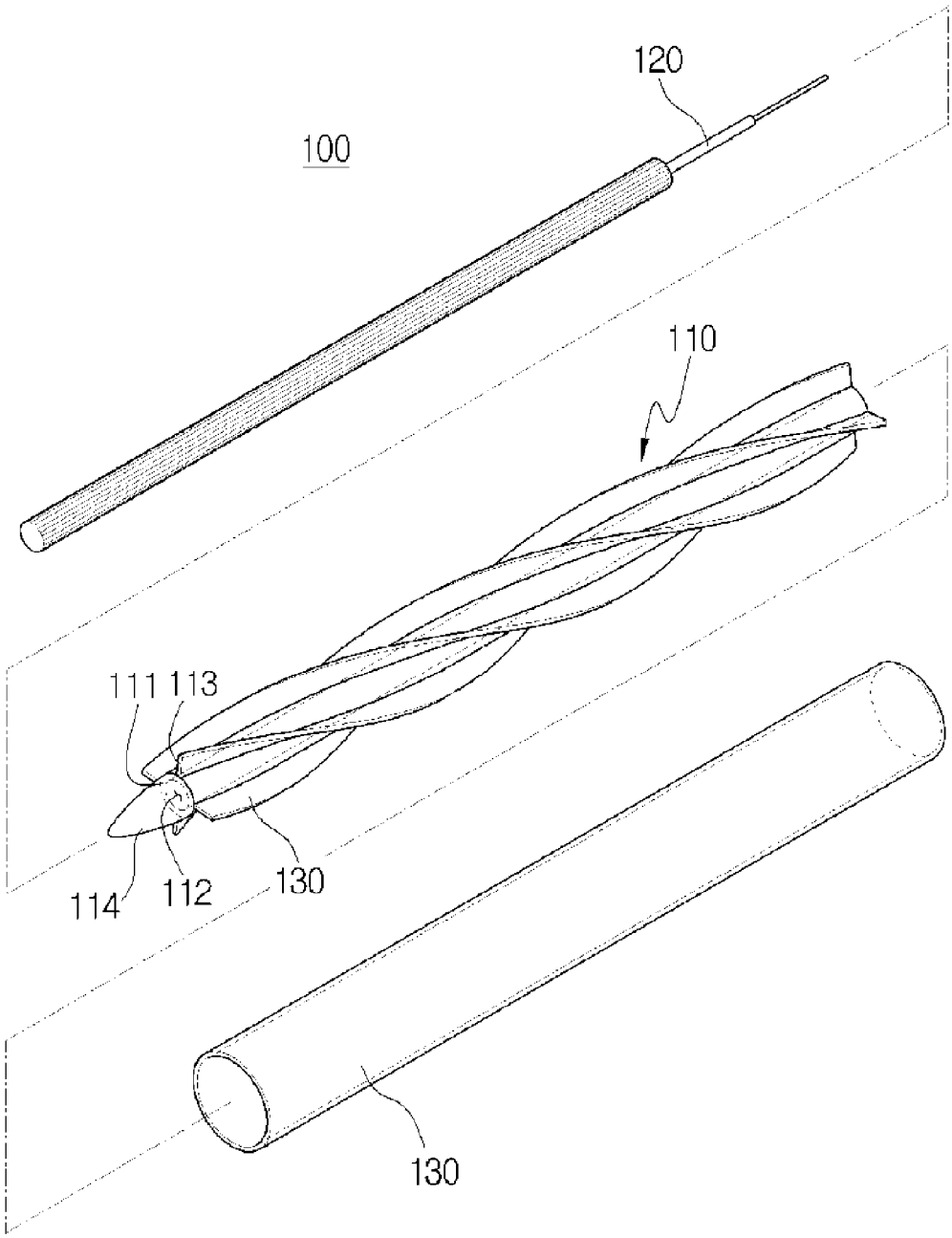
FIG. 4 is an exploded perspective view of the cartridge-type inline heater of FIG. 2.

FIG. 2 is a perspective view of a cartridge-type inline heater according to a first exemplary embodiment of the present invention, FIG. 3 illustrates a cross section of the cartridge-type inline heater taken along line III-III' of FIG. 2, and FIG. 4 is an exploded perspective view of the cartridge-type inline heater of FIG. 2.

Referring to FIGS. 2 to 4, the cartridge-type inline heater 10 according to the first exemplary embodiment of the present invention includes a heat exchanging unit 110, a heater 120, an exterior part 130, and a heat insulating member (not illustrated).

The heat exchanging unit 110, which is a member for transferring heat generated from the heater 120 to be described below to a working fluid by forming a fluid flowing path 115 through which the working fluid flows, includes a body part 111 and swirl parts 113.

The body part 111 is shaped like a cylinder and is made of a stainless steel material, but a shape and a material of the body part 111 is not limited thereto. In the meantime, a mounting part 112 is formed at a center of the body part 111 while passing through the body part 111 in a longitudinal direction so that the heater 120 to be described below may be mounted.

The swirl part 113 outwardly protrudes from an external circumferential surface of the body part 111, and is formed to be coiled in a spiral shape in a longitudinal direction of the external circumferential surface of the body part 111, and the swirl part 113 may be formed in the body part 111 by a method, such as bonding or diffusion bonding. A material of the swirl part 113 may be the same stainless steel as that of the body part 111, but is not limited thereto.

In the meantime, a plurality of swirl parts 113 is provided in the body part 111, and a space between one swirl part 113 and the swirl part 113 adjacent to the one swirl part 113 forms the fluid flowing path 115. That is, the swirl parts 113 facing while being adjacent to each other form a side wall surface of the fluid flowing path 115, and the external circumferential surface of the body part 111 forms a bottom surface of the fluid flowing path 115, and an interior circumferential surface of the exterior part 130 to be described later forms a top surface of the fluid flowing path 115. Further, the number of swirl parts 113 is plural, so that the fluid flowing paths 115 may also be formed as many as the number of provided swirl parts 113.

In the meantime, a height of the swirl part 113 may be determined considering an interior diameter of the exterior part 130 to be described later so that the swirl part 113 is in close contact with the interior circumferential surface of the exterior part 130, and the number of the swirl parts 113, a thickness of the swirl part 113, the number of times by which the swirl part 113 is coiled, and the like may be determined considering a specific flow condition, such as a flow rate, a temperature, and pressure of the flowing working fluid.

A finishing member 114 is a member for finishing an end portion of the mounting part 112 so as to prevent the heater 120 to be described below from being separated from the mounting part 112 to the outside.

The heater 120 is formed of a cartridge-type heater, in which an electric heating wire is inserted inside an elongated electric heating tube to generate heat. The heater 120 is mounted inside the mounting part 112 passing through the body part 111 in the longitudinal direction.

In the meantime, the heater 120 is formed in a cylindrical shape to be closely mounted inside the mounting part 112 having an interior diameter corresponding to an exterior diameter of the heater 120 and passing through the body part 111, so that the heat generated from the heater 120 may be transferred to the body part 111 without thermal loss. That is, an exterior surface of the heater 120 may be in complete contact with an internal surface of the mounting part 112 to maximize a heat transference area.

The exterior part 130 is formed in a cylindrical shape, and has an internal space, so that the body part 111 and the swirl parts 113 are accommodated inside the exterior part 130.

In the meantime, as described above, the swirl parts 113 are formed outside the body part 111, and the exterior part 130 is coupled with the heat exchanging unit 110 in a form in which the interior circumferential surface of the exterior part 130 is in close contact with an outermost end portion of the swirl part 113. As described above, the end portions of the swirl parts 113 are in close contact with the interior peripheral surface of the exterior part 130, so that it is possible to prevent the working fluids flowing in the fluid flowing path 115 formed at both sides of the swirl parts 113 from being exchanged each other.

The heat isolating member (not illustrated), which surrounds an external circumferential surface of the exterior part 130, is a member for minimizing thermal loss by preventing heat exchange of outside air with the exterior part 130.

From now on, an operation of the aforementioned first exemplary embodiment of the cartridge-type inline heater 100 will be described.

A working fluid flows in a space between the body part 111 and the exterior part 130, that is, the fluid flowing path 115 between the adjacent swirl parts 113, and simultaneously the heater 120 is operated to generate heat. The heat generated from the heater 120 is transferred to the flowing working fluid through the body part 111 to heat the working fluid.

Figure 5:
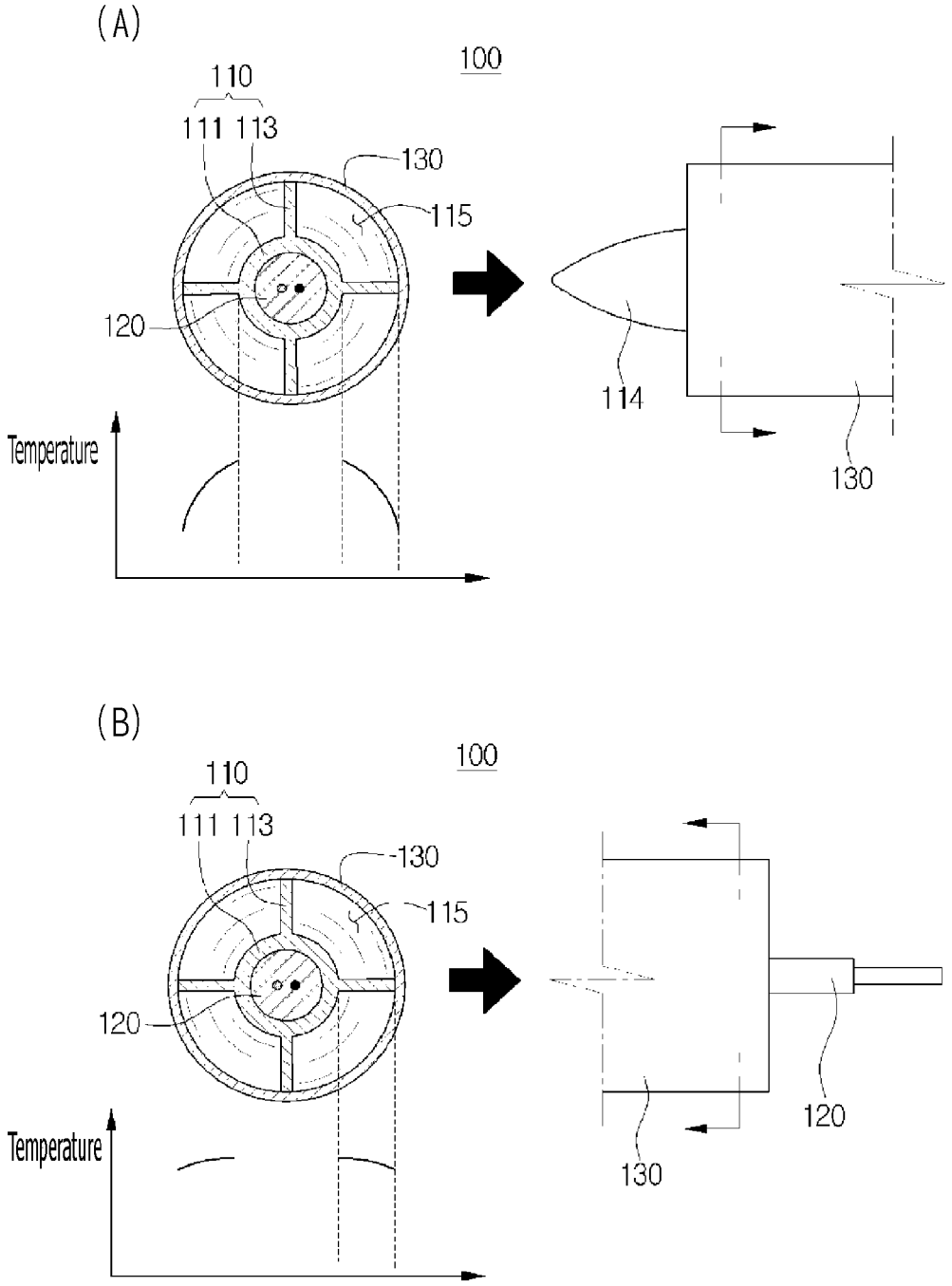
FIG. 5A illustrates a temperature gradient of a working fluid of a longitudinal section of a region in which the working fluid of the cartridge-type inline heater of FIG. 2 flows.
FIG. 5B illustrates a temperature gradient of a working fluid of a longitudinal section of a region from which the working fluid of the cartridge-type inline heater of FIG. 2 is discharged.
Figure 6:
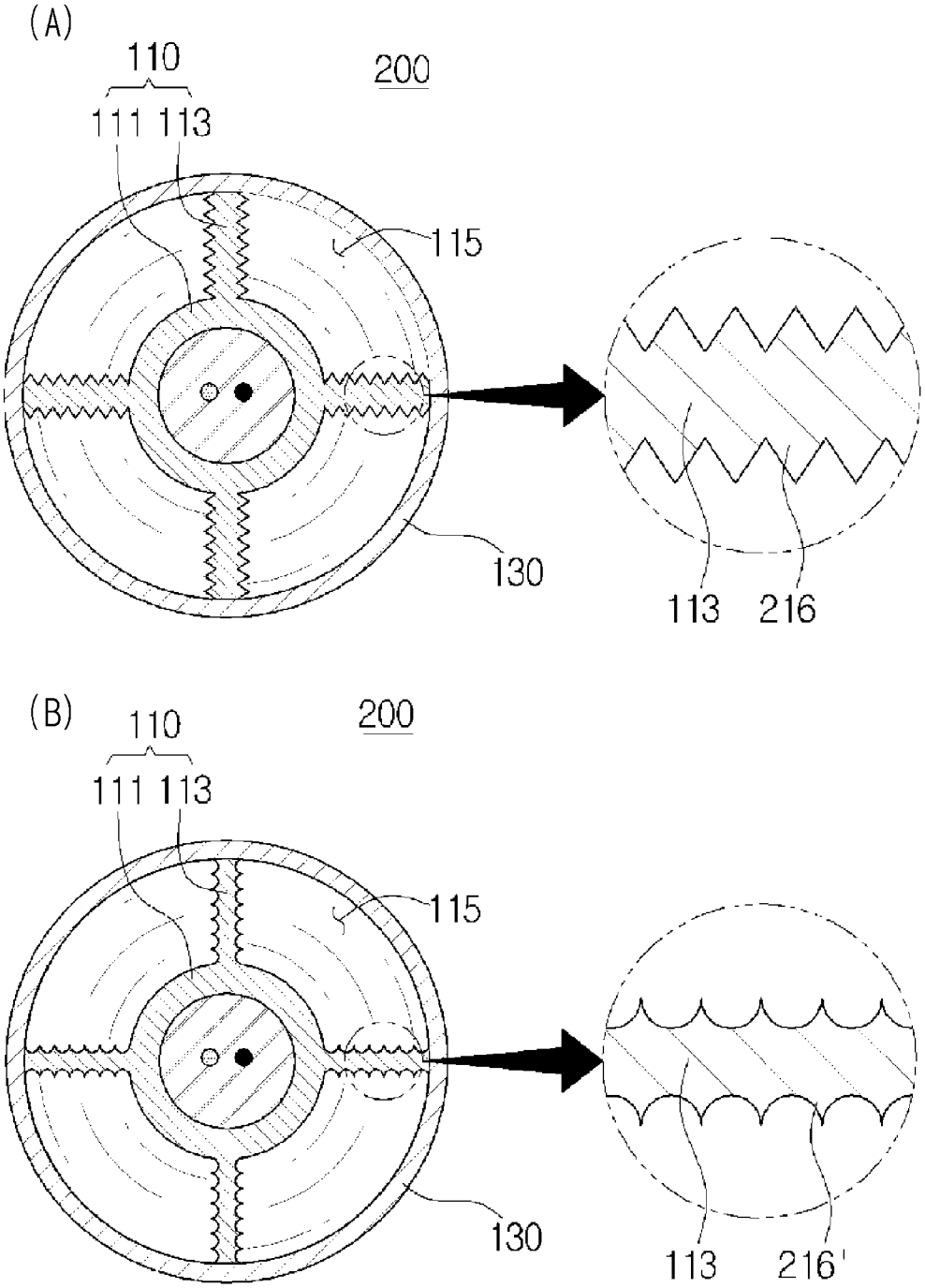
FIG. 6 is a cross-sectional view of a cartridge-type inline heater according to a second exemplary embodiment of the present invention.
Figure 7:
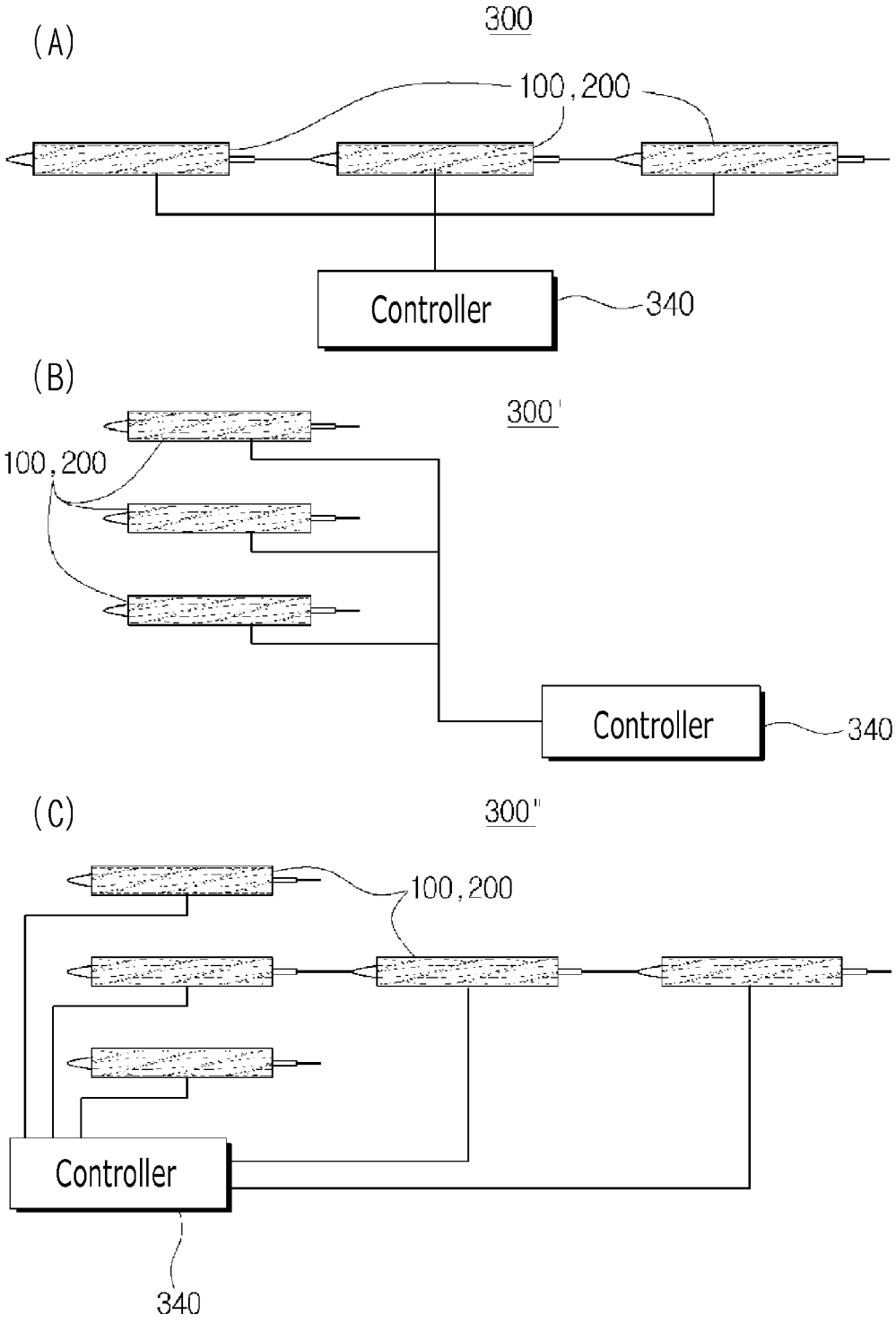
FIG. 7 schematically illustrates a system for controlling a working fluid temperature using the cartridge-type inline heater according to the exemplary embodiment of the present invention.

FIG. 5A illustrates a temperature gradient of the working fluid of a longitudinal section of a region in which the working fluid of the cartridge-type inline heater of FIG. 2 flows.

As illustrated in FIG. 5A, in view of the longitudinal section of the region, in which the working fluid flows inside the fluid flowing path 115, of the cartridge-type inline heater 100 of the present exemplary embodiment, it can be seen that a temperature of the working fluid is the highest at the body part 111 side adjacent to the heater 120, and is decreased as the longitudinal section becomes closer to an outer side.

However, the working fluid is influenced by the spiral-shaped swirl parts 113 to be compulsorily transferred in a spiral shape in a direction in which the swirl parts 113 are formed while the working fluid flows inside the fluid flowing path 115, and the working fluid is continuously stirred in a direction perpendicular to the longitudinal direction of the body part 111.

That is, the working fluid at a relatively high temperature state at a position adjacent to the heater 120 is repeatedly exchanged with the working fluid that is in a relatively low temperature state at a positioned spaced from the heater 120 toward the outside, so that the mutual heat exchange is performed. Accordingly, the working fluid flowing in the fluid flowing path 115 generally has a uniform temperature.

FIG. 5B illustrates a temperature gradient of the working fluid of a longitudinal section of a region from which the working fluid of the cartridge-type inline heater of FIG. 2 is discharged.

That is, as illustrated in FIG. 5B, in view of the longitudinal section of the region, from which the working fluid of the fluid flowing path 115 is discharged, of the cartridge-type inline heater 100 of the present exemplary embodiment, it can be seen that the temperature of the working fluid is almost maintained to be uniform regardless of the position.

Next, a cartridge-type inline heater 200 according to a second exemplary embodiment of the present invention will be described.

The cartridge-type inline heater 200 according to the second exemplary embodiment of the present invention includes a heat exchanging unit 110, a heater 120, an exterior part 130, and a heat insulating member (not illustrated). However, the heater 120, the exterior part 130, and the heat insulating member are the same as those aforementioned in the first exemplary embodiment, so that repeated descriptions will be omitted.

The heat exchanging unit 110, which is a member for transferring heat generated from the heater 120 to the working fluid by forming a fluid flowing path 115 through which the working fluid flows, includes a body part 111 and swirl parts 113. However, the body part 111 has the same configuration as that aforementioned in the first exemplary embodiment, so that a repeated description will be omitted.

The swirl part 113 is extended to an outer side of the body part 111, and is formed so as to be coiled in a spiral shape in a longitudinal direction of the body part 111.

In the meantime, in the present exemplary embodiment, a flow pattern 216 is formed on surfaces which are in contact with the flowing working fluid by forming both side surfaces of the swirl parts 113, that is, the side surface of the fluid flowing path 115. The flow pattern 216 may be a repeated prism pattern which is inwardly depressed or outwardly protrudes from the side surface of the swirl parts 113.

However, a shape of a flow pattern 216' may be a U-shaped pattern repeatedly formed on the side surface of the swirl parts 113, but is not limited thereto.

According to the flow patterns 216 and 216', it is possible to decrease flow resistance, such as pressure resistance and friction resistance, generated between the working fluid and the surfaces of the swirl parts 113 and improve fluidity of the working fluid.

Next, a system 300 for controlling a working fluid temperature by using the cartridge-type inline heater according to the first exemplary embodiment or the second exemplary embodiment of the present invention will be described.

The system 300 for controlling the working fluid temperature by using the cartridge-type inline heater of the present exemplary embodiment includes a plurality of cartridge-type inline heaters 100 and 200, and a controller 340.

The plurality of cartridge-type inline heaters 100 and 200 is provided in such a way that fluid flowing paths of the plurality of cartridge-type inline heaters 100 and 200 are connected with each other. Further, in the present exemplary embodiment, the cartridge-type inline heaters 100 and 200 are arranged in a straight-type structure in which the cartridge-type inline heaters 100 and 200 are arranged in a line in a longitudinal direction so that the working fluid flowing in the first cartridge-type inline heater 100 or 200 is discharged to the cartridge-type inline heater 100 or 200 disposed at a final end portion.

The controller 340 is a member for controlling the plurality of cartridge-type inline heaters 100 and 200 arranged in the straight-type structure.

In the meantime, in another modified example of a system 300' for controlling a working fluid temperature using the cartridge-type inline heater, the respective cartridge-type inline heaters 100 and 200 are disposed in a parallel-type structure in which the cartridge-type inline heaters 100 and 200 are disposed in a line in a width direction.

Still another modified example of a system 300" for controlling a working fluid temperature using the cartridge-type inline heater, the respective cartridge-type inline heaters 100 and 200 may be configured in a complex-type structure in which the straight-type structure and the parallel-type structure are combined.

An operation of the system for controlling the working fluid temperature by using the cartridge-type inline heater of the present exemplary embodiment will be described.

In the present exemplary embodiment, it is assumed that the plurality of cartridge-type inline heaters 100 and 200 is arranged in the complex-type structure for description. The controller 340 divides the respective cartridge-type inline heaters 100 and 200 into sections for each temperature of the discharged working fluid.

The controller 340 controls the temperature of the working fluid for each section by dividing the respective cartridge-type inline heaters 100 and 200 into a plurality of sections, calculating a heating degree of the working fluid at each section, and then transmitting temperature information to the cartridge-type inline heaters 100 and 200 included in each section.

The scope of the present invention is not limited to the aforementioned exemplary embodiment, but may be implemented with various types of exemplary embodiments within the appended claims. It will be understood by those skilled in the art that various modifications and changes belong to the scope of the present invention without departing from the principles of the present invention defined by the appended claims.

What is claimed is:

1. A cartridge-type inline heater, comprising:

a heat exchanging unit including a body part in which a mounting part is formed in a longitudinal direction, and a plurality of swirl parts protruding from an external circumferential surface of the body part;

an exterior part accommodating the heat exchanging unit, the exterior part being a pipe through which a working fluid flows; and a heater including a tube being in a cylindrical shape, and an electric heating wire inserted inside the tube, the heater mounted inside the mounting part and configured to heat the working fluid which is in contact with the heat exchanging unit but not with the heater, wherein, the working fluid flows in a space between the heat exchanging unit and the exterior part, the plurality of swirl parts is formed to be coiled in a spiral shape in a longitudinal direction of the external circumferential surface of the body part, the exterior part is mounted to be spaced apart from the body part while surrounding the plurality of swirl parts, the mounting part is formed in a cylindrical shape at a center of the body part while passing through the body part in the longitudinal direction, and has an interior diameter corresponding to an exterior diameter of the tube, and an exterior surface of the tube is in contact with an internal surface of the mounting part, and a flow pattern is formed on a surface of the swirl part which is in contact with the working fluid, the flow pattern being a repeated pattern which is inwardly depressed or outwardly protrudes from the surface of the swirl parts.

2. The cartridge-type inline heater of claim 1, wherein:

the plurality of swirl parts is formed to be spaced apart from each other in a circumferential direction of the body part, and a fluid flowing path, through which the working fluid flows, is formed in a space between the adjacent swirls parts.

3. The cartridge-type inline heater of claim 2, wherein:

the exterior part is mounted to be in close contact with the swirl parts so as to prevent the working fluid flowing inside any one fluid flowing path based on the swirl parts from flowing to an adjacent fluid flowing path.

* * * * *